United States Patent [19]

Bosch

[11] Patent Number: 4,966,333

[45] Date of Patent: Oct. 30, 1990

[54] METHOD OF CONTROLLING TENSION IN A YARN SHEET DURING WINDING

[75] Inventor: Bernd Bosch, Monchengladbach, Fed. Rep. of Germany

[73] Assignee: Gebruder Sucker & Franz Muller GmbH & Co., Monchen-Gladbach, Fed. Rep. of Germany

[21] Appl. No.: 255,876

[22] Filed: Oct. 11, 1988

[30] Foreign Application Priority Data

Oct. 12, 1987 [DE] Fed. Rep. of Germany ..... 3734433

[51] Int. Cl.[5] ..... B65H 59/00

[52] U.S. Cl. ..... 242/75.51; 28/194

[58] Field of Search ..... 242/75.51, 75.52, 75.44, 242/57; 28/194, 196, 197

[56] References Cited

U.S. PATENT DOCUMENTS

| | | | |
|---|---|---|---|
| 3,244,954 | 4/1966 | Branco | 242/75.52 X |
| 3,898,436 | 8/1975 | Pottebaum et al. | 242/75.51 X |
| 4,525,905 | 7/1985 | Bogucki-Land | 28/194 |
| 4,565,334 | 1/1986 | Ruhl | 242/75.51 X |
| 4,736,900 | 4/1988 | Okamura | 242/75.52 |

FOREIGN PATENT DOCUMENTS

| | | | |
|---|---|---|---|
| 0038260 | 3/1982 | Japan | 242/75.51 |
| 0051658 | 3/1982 | Japan | 242/57 |
| 0135050 | 8/1983 | Japan | 242/75.44 |
| 0092848 | 5/1984 | Japan | 242/75.51 |
| 0037652 | 2/1986 | Japan | 242/75.44 |
| 0914455 | 3/1982 | U.S.S.R. | 242/75.44 |

*Primary Examiner*—Katherine Matecki

*Attorney, Agent, or Firm*—Shefte, Pinckney & Sawyer

[57] ABSTRACT

Yarn sheet tension in a warp beaming operation is controlled by supplying a primary analog correcting signal to the drive of the warp beam based upon ultrasonic measurement of the progressively increasing effective beam diameter and by adding a supplementary proportional-plus-integral-plus-derivative (PID) correcting signal thereto based upon detected movements of a movable dancer roll biased into peripheral engagement with the yarn sheet as it is delivered to the warp beam.

2 Claims, 1 Drawing Sheet

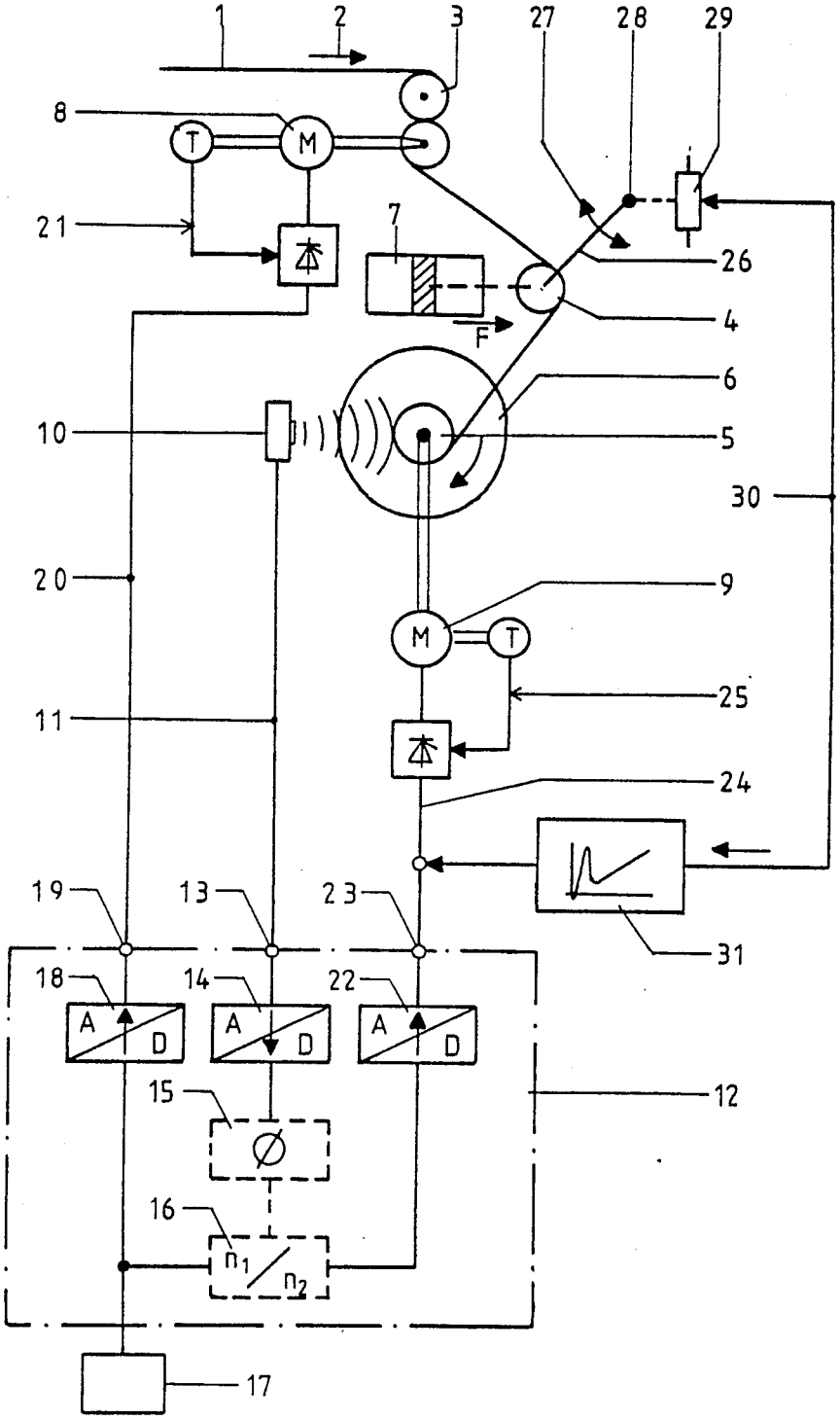
1
2
3
27
28
29
8
T
M
21
7
26
4
F
6
10
5
30
20
9
M
T
25
11
24
19
13
23
31
18
14
22
A
D
A
D
A
D
15
12
16
$n_1$
$n_2$
17

METHOD OF CONTROLLING TENSION IN A YARN SHEET DURING WINDING

BACKGROUND OF THE INVENTION

The present invention relates generally to a method of controlling the tension in a plurality of yarns during delivery in the form of a sheet for winding about a suitable winding core, e.g., in the preparation of a warp beam or the like.

In the preparation of warp beams and the like, a plurality of textile yarns are transported in side-by-side, generally parallel relation in the form of a sheet successively via a pair of driven delivery rollers, peripherally about a movable dancer roller and onto a driven winding core, such as a warp beam. A desired level of tension in the yarn sheet is obtained by biasing the dancer roller, e.g. pneumatically, into peripheral engagement with the traveling yarn sheet while at the same time driving the pair of delivery rollers and the warp beam at differential peripheral speeds. As will be understood, as the yarn sheet is progressively wound about the warp beam, the effective diameter of the beam gradually increases which, in turn, necessitates a gradual reduction in the driven axial speed of the warp beam to maintain a constant peripheral speed of the beam for yarn take-up. Typically, the driven speed of the warp beam is suitably controlled over the course of the winding operation according to a predetermined program stored in a suitable programmable controller.

While the dancer roller is supported so as to be movable in response to tension fluctuations in the yarn sheet during the winding operation, it is preferred that the yarn sheet tension be maintained as constant as possible so that the dancer roller is maintained generally stationary in static equilibrium at a predetermined desired residence position and does not move substantially therefrom. Thus, during winding operation, the dancer roller may move in response to tension fluctuations by only minimal amounts on the order of at most 1 centimeter from its static residence position. Accordingly, the tension-responsive movements of the dancer roller do not provide a suitable reference for making basic corrections or for providing the primary control of adjustments in the driven speed of the warp beam or other winding core in relation to the traveling speed of the yarn sheet as determined by the driven speed of the delivery rollers.

SUMMARY OF THE INVENTION

It is accordingly an object of the present invention to provide a method by which the driven speed of a warp beam or other winding core in a winding system of the above-described type may be adjusted in relation to the progressively increasing diameter of the core with as little deflection or movement of the dancer roller from its desired static residence location as possible. It is a further object of the present invention to provide such a method of controlling speed adjustment of the winding core without the need for manual regulation. Particularly, it is an object of the present invention to enable the start-up of a winding operation without requiring any manual presetting of operating parameters regardless of the prevailing diameter of the winding core.

Briefly summarized, the tension control method of the present invention involves the steps of ultrasonically determining the actual diameter of the yarn sheet wound on the winding core, producing a primary analog correcting signal representing the yarn sheet diameter, and adjusting the driven speed of the winding core in relation to the primary analog correcting signal, thereby to provide a basic adjustment of the speed of the winding core as the windings of the yarn sheet progressively build thereon. At the same time, movements of the dancer roll are detected, a supplementary proportional-plus-integral-plus-derivative (PID) correcting signal is produced representative of the detected movements of the dancer roller, and the supplementary correcting signal is added to the primary analog correcting signal to achieve fine adjustment of the driven speed of the winding core.

More particularly, an ultrasonic distance measuring device of a type adapted to produce an analog output signal is utilized for monitoring the actual effective diameter of the windings of the yarn sheet on the winding core, with the analog output signal of the ultrasonic measuring device being supplied to a programmable controller which is operative to develop the primary correcting signal according to a predetermined stored program. As an option, the actual effective diameter of the winding core as determined by the ultrasonic measuring device may be checked for plausibility (e.g., the programmable controller may perform appropriate inquiries to determine whether the winding core is empty or whether otherwise an erroneous diameter measurement has been obtained), and the diameter measurement then processed to develop an average diameter value. In either case, a pilot control value for the driven speed of the winding core is calculated by the programmable controller in relation to the actual diameter value from a predetermined theoretical value for the traveling delivery speed of the yarn sheet, thereby to provide a basic or primary adjustment of the winding core speed.

As a supplementary fine adjustment of this basic or primary adjustment of the winding core speed based upon the delivery speed of the yarn sheet and the actual effective winding core diameter, slight movements of the dancer roller deviating from its predetermined desired static residence position are utilized to produce a PID control signal representative of such slight deviations, which control signal is then added to the pilot speed signal determined under the basic adjustment of the winding core speed. In this manner, any residual error which may exist in the basic speed adjustment of the winding core according to the effective core diameter, such as may result if the yarn sheet windings are non-circular or from changes in yarn elasticity or from dynamic deviations in the yarn winding operation, are eliminated.

BRIEF DESCRIPTION OF THE DRAWING

The accompanying drawing is a schematic diagram of a winding tension control system according to the preferred embodiment of the present invention.

DESCRIPTION OF THE PREFERRED EMBODIMENT

Referring now to the accompanying drawing, there is schematically illustrated an apparatus for winding a sheet of a plurality of textile yarns in side-by-side relation onto a warp beam wherein basically the yarn sheet 1 travels in the direction of the arrow 2 in sequence peripherally about a pair of driven delivery rollers 3, peripherally about a movable dancer roller 4, and is then wound onto a driven warp beam 5 of a warp beaming machine generally indicated in its entirety at 6.

The winding tension in the yarn sheet 1, which may be designated as F, is generated cooperatively by a pneumatically-operated piston-and-cylinder assembly 7 associated with the dancer roller 4 for biasing it into engagement with the yarn sheet 1 and by setting the respective drive motors 8, 9 to the delivery rollers 3 and the warp beam 5 to provide a speed differential between the peripheral speed of the delivery rollers 3 and the peripheral speed of the developing warp beam 5. Specifically, the drive motor 8 for the pair of delivery rollers 3 is preferably a variable-speed direct-current motor set to drive the delivery rollers 3 at a surface speed n1. The drive motor 9 for the warp beam 5, also preferably a variable-speed direct-current motor, is independent of the delivery roller drive motor 8 and is set to drive the warp beam 5 at a surface speed n2.

As the yarn sheet 1 is gradually wound about the warp beam 5, the progressively increasing diameter of the yarn windings about the warp beam 5 is detected by an ultrasonic measuring device 10 operable in a known manner. The ultrasonic measuring device 10 produces an analog output signal which is supplied via a lead 11 to an input 13 of a programmable controller 12. The analog output signal from the ultrasonic measuring device 10 representing the actual effective diameter of the warp beam 5 is digitized in the programmable controller 12 by an analog-to-digital converter 14. The programmable controller 12 is programmed to produce a pilot control signal 16 representing the theoretical desired value of the ratio of the surface speed n1 of the delivery rollers 3 with respect to the surface speed n2 of the warp beam 5. The converted digital signal 15 developed by the analog-to-digital converter 14 from the output signal of the ultrasonic measuring device 10 is utilized by the programmable controller 12 as representing the average value of the actual warp beam diameter, with the programmable controller 12 adjusting the theoretical pilot control signal 16 in relation to the converted digital signal 15.

The programmable controller 12 is provided with an input device 17 by which may be preset a desired theoretical digitized value for the speed of the drive 8 to the pair of delivery rollers 3, thereby to set the desired traveling delivery speed of the yarn sheet 1. This preset digitized value is converted to analog form by a digital-to-analog converter 18 and the analog value is transmitted by an output 19 of the programmable controller 12 via a lead 20 to a suitable speed control device 21 associated with the delivery roller drive 8. At the same time, the programmable controller 12 utilizes the theoretical digitized value from the input device 17 in calculating the theoretical pilot control ratio n1/n2 16 which value, in turn, is converted into analog form by another digital-to-analog converter 22 and the analog value is fed through an output 23 of the programmable controller 12 and through a lead 24 to a speed control device 25 associated with the drive 9 to the warp beam 5.

As will be understood, since the theoretical pilot control value 16 is constantly corrected according to the average actual diameter value 15 obtained from the ultrasonic measuring device 10, the driven speed n2 of the warp beam 5 is well adapted in a simple manner to the driven speed n1 of the delivery rollers 3 in accordance with the particular sheet of yarns 1 being wound. Particularly, the continuous diameter-related adjustment of the warp beam speed through its drive 9 serves to minimize the degree of deflecting movement of the dancer roller 4 from its predetermined desired static residence location. Further, since the actual effective diameter of the wound warp beam 5 is constantly being supplied to the programmable controller 12 and utilized in adjusting the theoretical pilot control ratio value n1/n2 16, the winding process may be started from any wound diameter of the warp beam 5 without requiring any initial mechanical adjustments of the winding apparatus.

The dancer roller 4 is mounted at the free end of an arm 26 the opposite end of which is pivotably supported at a pivot bearing 28 for pivotal movement in opposite directions indicated by the arrow 27. Upon any pivotal deflection of the dancer roller 4 from its predetermined residence location, the angular degree of the pivoted deflection is detected by a poteniometer 29 associated with the pivoted arm 26. The potentiometer 29 is adapted to produce a signal representing the angular degree of deflection and to feed the signal by a lead 30 to a proportional-plus-integral-plus-derivative (PID) regulator device 31 of the type adapted in a known manner to produce a control signal which is proportional to the sum of the deflection signal from the potentiometer 29, its integral, and its derivative. The output signal of the PID regulator device 31 is delivered to the lead 24 and is superimposed on the converted analog signal representing the theoretical pilot control ratio value 16 supplied along the lead 24 from the output 23 of the programmable controller 12, thereby to adjust the signal delivered to the warp beam speed control device 25 in relation to any deviations of the dancer roller 4 from its desired predetermined static residence position.

Thus, any residual errors in the development of the primary speed adjusting signal to the warp beam speed control device 25 by the programmable controller 12, such as may result from dynamic deviations caused by non-circularity of the yarn windings on the warp beam 5 or by variations in the elasticity of the yarn sheet 1, are eliminated since such factors will affect the desired static disposition of the dancer roller 4 which will result in the addition to the warp beam speed control signal of a PID control signal from the regulator 31, thereby providing for fine adjustment of the speed control of the warp beam 5.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

I claim:

1. A method of controlling tension in a plurality of yarns during delivery in the form of a sheet successively from a driven delivery roller, peripherally about a movable dancer roller, and onto a driven winding core, said method comprising the steps of biasing said dancer roller toward peripheral engagement with the yarn sheet and driving said delivery roller and said winding core at different circumferential speeds to tension the yarn sheet, controlling the driven speed of said delivery roller according to a predetermined control program, ultrasonically determining the actual diameter of the yarn sheet wound on said winding core, producing a primary analog correcting signal representing the yarn sheet diameter, adjusting the driven speed of said winding core in relation to said primary analog correcting signal, detecting movements of said dancer roller, producing a supplementary proportional-plus-integral-plus-derivative correcting signal representing detected movements of said dancer roller, said supplementary correcting signal being derived proportionally, integrally and derivatiely from the detected movements of said dancer roller, and adjusting said primary analog correcting signal as a function of said supplementary correcting signal for fine adjusting of the driven speed of said winding core.

2. A method of controlling tension in a yarn sheet during winding according to claim 1 and characterized further by establishing a predetermined desired residence position for said dancer roller, said supplementary correcting signal being determined for maintaining said dancer roller generally stationary at said residence position.

* * * * *